United States Patent [19]

Steverding

[11] Patent Number: 4,991,663

[45] Date of Patent: Feb. 12, 1991

[54] SHUT-OFF VALVE HAVING VARIABLE INPUT

[76] Inventor: James F. Steverding, Stanley Air Tools, Div. of The Stanley Works, 700 Beta Dr., Cleveland, Ohio 44143

[21] Appl. No.: 286,759

[22] Filed: Dec. 19, 1988

[51] Int. Cl.[5] ..... B25B 23/14

[52] U.S. Cl. ..... 173/12; 137/505.18

[58] Field of Search ..... 173/12, 168, 169; 137/102, 505.11, 505.13, 505.18

[56] References Cited

U.S. PATENT DOCUMENTS

| | | | |
|---|---|---|---|
| 2,721,572 | 10/1955 | MacDonnell | 137/102 |
| 2,793,075 | 5/1957 | Gulick | 137/505.11 X |
| 3,385,378 | 5/1968 | Weber et al. | 137/102 X |
| 3,904,305 | 9/1975 | Boyd | 173/12 X |
| 4,434,858 | 3/1984 | Whitehouse | 173/12 |
| 4,635,671 | 1/1987 | Viegas | 137/102 |
| 4,844,176 | 7/1989 | Podsobinski | 137/505.13 X |

*Primary Examiner*—Stephen M. Hepperle
*Attorney, Agent, or Firm*—Hayes & Reinsmith

[57] ABSTRACT

A shut-off valve 50 is disclosed including annular grooves 54 and a valve sleeve 26 including openings 36 which are configured and located relative to each other to define an orifice of variable flow area for supplying fluid from supply passage 16*s* to motor 16*m*, the variable orifice having less than maximum flow area when valve 50 is in a normally open position and the variable orifice expanding to maximum flow area during a portion of the travel of valve 50 from the normally open position to a shut-off position.

18 Claims, 2 Drawing Sheets

M
V
T
10
12
14
16
18
20
24
26
28
30
34
36
38
42
44
50
54
56
58
62
64
68
70
74
76
78
80
84
86
90
94
100
104
106
110
112
16b
16s
16m 120
124
126
86'
106'
100'
64'
44'
16m'
42'
26'
50'
24'
54'
34'
38'
16s'
16b'
172
70'
166
168
12'
192
196
198
190
194
68'
36'

SHUT-OFF VALVE HAVING VARIABLE INPUT

BACKGROUND OF THE INVENTION

This invention relates to fluid operated power tools and, more particularly, to a new and improved shut-off valve for such tools.

One area of use of the present invention is in tightening threaded fasteners, although the principles of the present invention can be variously applied. Fluid operated power tools for such use typically are provided with a shut-off valve to shut off the supply of motive fluid to the tool automatically when the desired torque is reached. An important consideration in the design of such tools is the capability defined in terms of the amount of torque variation of the tool run on a variety of jobs from hard to soft. On hard jobs, the tool stops suddenly, and inertial energy from high speed motor elements tends to increase final torque, while on soft jobs inertial energy is dissipated in heat during tool deceleration. In the power fastening art, a practical limit for a hard job is one in which the fastener goes from loose to tight in a turn of thirty degrees, and the practical limit for a soft job is one in which the fastener goes from loose to tight in two revolutions or more. That is to say, after two revolutions of tightening, inertial effects on a power-driven fastener are negligible. Such inertial effects increase exponentially as tightening angle is decreased. Very rarely are threaded joints designed to reach desired torque in less than 30 degrees. Accordingly, the shut-off valve of such fluid-operated power tools will encounter variations in fastening jobs which will affect fastener torque at tool shut-off.

It would, therefore, be highly desirable to provide a fluid-operated power tool including a shut-off valve having improved capability in substantially matching the torque achieved on hard jobs with the torque achieved on soft jobs. In addition, it would be advantageous to provide such a tool having reduced impulse or kick at shut-off and wherein peak torque is relatively close to set torque, with less variation. The foregoing desirably should be achieved by a shut-off valve of relatively simple construction which is efficient and effective in operation.

SUMMARY OF THE INVENTION

It is, therefore, a primary object of this invention to provide a new and improved fluid-operated power tool having a shut-off valve providing improved capability.

It is a more particular object of this invention to provide such a power tool wherein the torque achieved on hard jobs substantially matches the torque achieved on soft jobs.

It is a further object of this invention to provide such a power tool having reduced impulse or kick at shut-off.

It is another object of this invention to provide such a power tool wherein peak torque is relatively closer to set torque, with less variation.

It is a more particular object of this invention to provide such an improved power tool with a shut-off valve of relatively simple construction and efficient and effective operation.

The present invention provides a fluid operated power tool wherein a shut-off valve is movable between a run position and a shut-off position for controlling fluid flow from a supply passage to a motor passage, wherein fluid under motor operating pressure is utilized to move the valve away from the run position toward the shut-off position and wherein the valve is biased toward the run position until a specified torque load on the tool motor is reached whereupon the valve is moved to the shut-off position, and characterized by means including the valve for providing an input orifice of variable area for supplying fluid from the supply passage to the motor passage, the variable orifice having less than maximum flow area when the valve is in the run position and expanding to maximum flow area during a portion of the travel of the valve from the run position to the shut-off position. The variable input orifice reduces variation in achieved torque. In another aspect of the present invention, fluid is dumped from the motor passage and the flow of bias fluid acting on the valve is stopped when the valve reaches the shut-off position. As a result, the tool has reduced impulse or kick at shut-off, and peak torque is relatively closer to set torque, with less variation.

The foregoing and additional advantages and characterizing features of the present invention will be clearly apparent upon a reading of the ensuing detailed description together with the included drawing wherein:

BRIEF DESCRIPTION OF THE DRAWING FIGURES

DETAILED DESCRIPTION OF THE ILLUSTRATED EMBODIMENTS

In a basic fluid operated power fastening tool, a normally open shut-off valve controls the fluid flow from a supply passage to a motor passage, and the valve is biased in a manner maintaining valve travel rate of displacement from the normally open position to a shut-off position proportional to the rate of increase in a torque load on the motor during loading of the tool. In the tool of the present invention, the valve is arranged relative to openings in the valve chamber to define an input orifice of variable flow area for supplying fluid from the supply passage to the motor passage, the variable input orifice having less than maximum flow area when the valve is in the normally open position and the variable input orifice expanding to maximum flow area during a portion of the travel of the valve from the normally open position to the shut-off position. As a result, the variable input orifice reduces variation in achieved torque over a range of significantly different work requirements. In addition, fluid is dumped from the motor passage and the flow of fluid acting on the valve is stopped when the valve reaches the shut-off position with the result that the tool has reduced impulse or kick at shut-off, and peak torque is relatively closer to set torque, with less variation.

Figures 1, 2, 3:
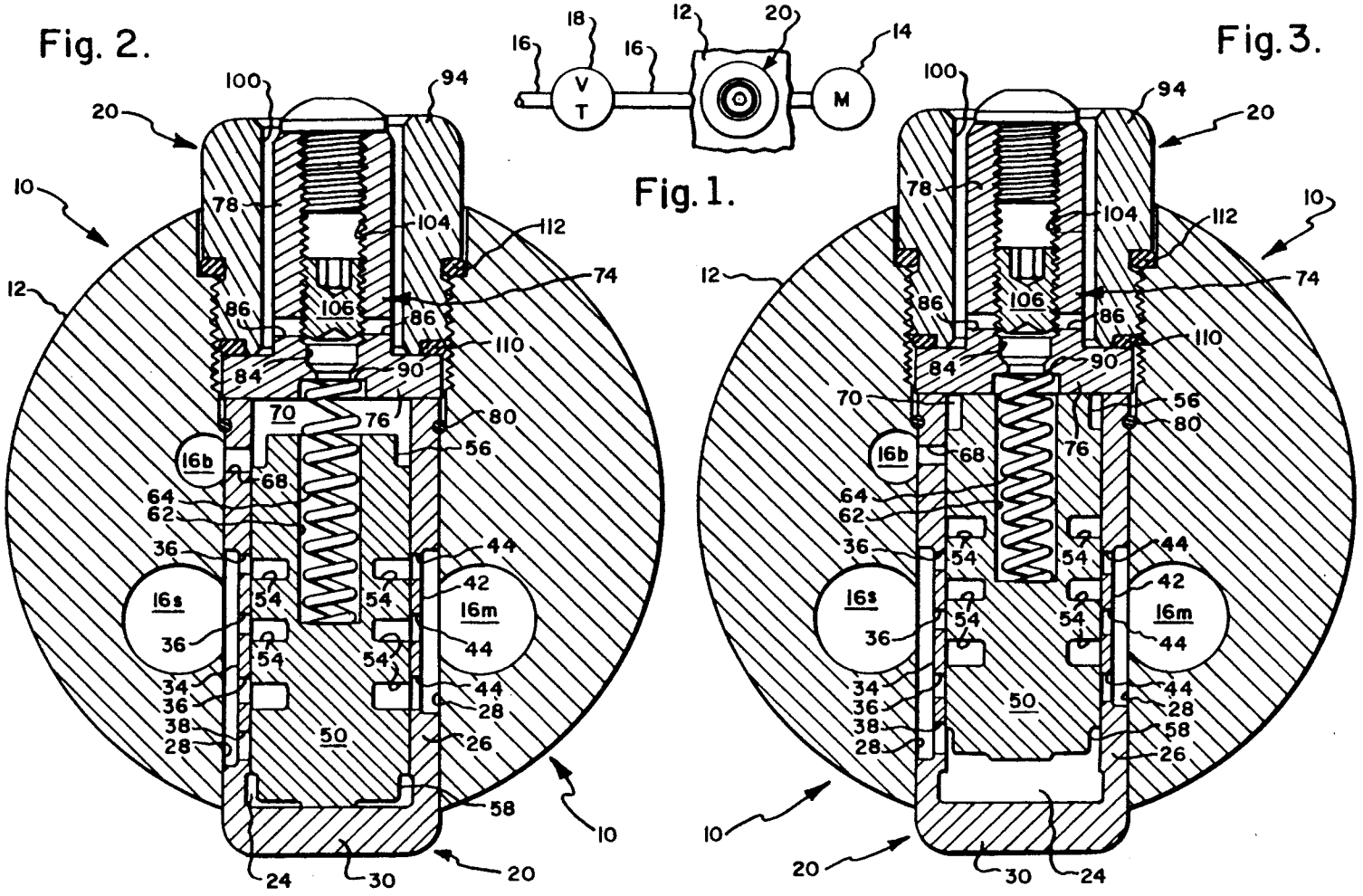
FIG. 1 is a schematic view showing a shut-off valve of the present invention interposed in a fluid supply line between a fluid-operated motor of a power tool and a throttle valve.
FIG. 2 is a sectional view of a fluid-operated power tool incorporating the present invention and showing the shut-off valve in an open position.
FIG. 3 is a sectional view similar to FIG. 2 and showing the shut-off valve in a closed position.

Referring to FIGS. 1–3, a power tool such as a power screwdriver, nutsetter or similar fluid-operated tool is shown in cross-section at 10 in FIGS. 2 and 3 having a generally cylindrical housing 12 and including a fluid motor shown schematically at 14 in FIG. 1. Motor 14 preferably is a conventional rotary vane air motor of the general type shown, for example, in U.S. Pat. No. 3,373,824 issued Mar. 19, 1968, entitled "Fluid Operated Tool" and assigned to the assignee of this invention. Motor 14 is mounted in housing 12 for driving a spindle, not shown, which will be understood to be operatively connected to a work engaging element of the tool. Compressed air from a suitable source is fed to a supply line 16 formed within housing 12 for driving air motor 14, and air flow to motor 14 is controlled by any suitable on-off control valve such as a throttle valve 18 having a manually-operated lever or the like accessibly located on or adjacent the tool handle.

A shut-off valve generally designated 20 controls the flow of fluid from supply line 16 to motor 14 as a function of torque at the tool output which, in turn, is indicated by fluid pressure at motor 14. A valve chamber 24 is defined by means in the form of a sleeve 26 fitted in a bore 28 provided in housing 12. Sleeve 26 is open at one end and closed at the opposite end by a wall 30. The valve chamber 24 is located between a supply passage **16*s* and a motor passage 16*m*, both provided in housing 12 and in fluid communication with supply line 16 and motor 14, respectively. Sleeve 26 has a flat 34 on one portion of the sidewall thereof adjacent supply passage 16*s*, and sleeve 26 is provided further with orifice means in the form of a series of openings 36 in the portion of the sleeve wall containing flat 34. Openings 36 provide fluid communication between supply passage 16*s* and valve chamber 24. An additional opening 38 is provided in the sleeve sidewall for a purpose to be described. The diametrically opposite portion of the sleeve sidewall has a flat 42 adjacent motor passage 16*m*, and sleeve 26 is provided with orifice means in the form of a series of openings 44 in the portion of the sleeve sidewall containing flat 42. Openings 44 provide fluid communication between motor passage 16*m* and valve chamber 24**.

A cylindrical valve spool 50 is located in sleeve 26 in close-fitting relationship therewith and is movable axially along within sleeve 26 between a normally open or run position show in FIG. 2 and a closed or shut-off position shown in FIG. 3. Spool 50 includes orifice means in the form of a series of passages 54 in the body of spool 50 and located so as to provide fluid communication between openings 36 and 44 and thus passages **16*s* and 16*m* when spool is in the normally open position of FIG. 2. Each passage is annular, formed along the outer surface of spool 50 and disposed in a plane extending laterally of the longitudinal axis of spool 50. In the valve shown, there are three passages 54 corresponding to the three openings 36 and the three openings 44 in sleeve 26. Spool 50 is provided with reduced diameter portions 56, 58 of relatively short axial length at the opposite ends thereof. Spool 50 also is provided with a longitudinal bore 62 extending inwardly from the end of spool 50 remote from sleevewall 30 which retains a coil spring 64**, the outer end of which contacts another component of the valve which will be described.

A bias passage **16*b* is provided in housing 20 in fluid communication with supply line 16, and a bias opening 68 is located in sleeve 26 so as to place bias passage 16*b* in fluid communication with a bias chamber 70 when valve spool 50 is in the open position illustrated in FIG. 2. Bias chamber 70 is defined partly by the end portion of sleeve 26 and is completed by the end face of a valve block element 74 mounted in housing 12 adjacent the open end of sleeve 26. In particular, valve block 74 has a disc-shaped end flange portion 76 which abuts the end of sleeve 26 and a cylindrical body portion 78 of smaller diameter extending from flange 76. The outer diameter of flange 76 is substantially equal to the outer diameter of sleeve 26, and sleeve 26 is closed by flange 76. A circular ring 80 in a groove in sleeve 26 abuts the adjacent surface of housing 12 maintaining the axial position of sleeve 26 in housing 12. Flange 76 is provided with a longitudinally extending bleed passage 84 which is in fluid communication with radially outwardly extending bores or passages 86 in body 78. The end of return spring 64 is received in passage 84 and retained by an annular step 90 in the wall of passage 84**.

Valve block 74 is held in place by a packing nut 94 threaded in housing 12, one end of nut 94 abuting annular flange 76 of valve block 74 and the opposite end of nut 94 extending beyond the surface of housing 12. The inner diameter of nut 94 is slightly greater than the outer diameter of valve block body portion 78 so as to define an annular passage 100 open to the atmosphere external to housing 12 and in fluid communication with passages 86. Valve block 74 is provided with a threaded internal longitudinal bore 104 containing an externally threaded adjustable valve 106 which extends toward bleed passage 84. A fluid tight seal between the end of packing nut 94 and valve block flange 76 is provided by an annular sealing O-ring 110 and, similarly, an annular sealing O-ring 112 is located between nut 94 and housing 12.

In operation, inlet air flows from throttle valve 18 to valve inlet passage **16*s* to flat 34 on valve sleeve 26, through slots 36 to annular grooves 54 in shutoff valve spool 50, through slots 44 to flat 42 and to the motor 14 through motor passage 16*m*. Inlet air also flows from flat 34 to hole 38, and leaks through the fit between sleeve 26 and shutoff valve 50 to chamber 24. Pressurized air in chamber 24 also leaks through the sleeve and shutoff valve fit to grooves 54, through slots 44 to motor passage 16*m*. Air pressure in chamber 24 varies directly with air pressure in passage 16*m*. Air is also admitted from the throttle to bias passage 16*b*, and through bias hole 68 to bias chamber 70. Bias chamber 70 is bled through passage 84 past adjustable valve 106 to passages 86 to passage 100 between valve block 74 and packing nut 94 to atmosphere. Air pressure in bias chamber 70 is kept at a constant percentage of inlet air pressure in passage 16*s*, but higher than pressure in chamber 24 when motor 14 is running free. As the tool is loaded, running a fastener, pressure in chamber 24 increases, until just before the motor stalls, when pressure chamber 24 exceeds pressure in bias chamber 70, causing shutoff valve 50 to shift to the shut-off position shown in FIG. 3. As the valve shifts, bias opening 68 is shut off by valve 50, lowering pressure further in the bias chamber 70, hole 38 is opened directly to inlet pressure from passage 16*s* and flat 34, urging valve 50 more quickly to the shut-off position, and annular grooves 54 in shutoff valve 50 move completely out of register with slots 36 and 44 in the shutoff sleeve 26 cutting off flow to the motor 14. The light return spring 64, preloaded in the run position, is compressed further in the shut-off position. At shut off, compressed air in passage 16***m* flows to atmosphere through the motor 14. When the throttle 18 is released, compressed air in chamber 24 also leaks to passage 16*m* and to atmosphere, and return spring 64 resets the shutoff valve 50 to the run position, ready for the next fastener run.

In accordance with the present invention, and shown in FIG. 2, the openings or slots 36 in sleeve 26 do not register perfectly with annular grooves 54 in shutoff valve 50 at the run position. On a soft job, as the motor 14 approaches stall, pressure in the motor 14 and in chamber 24 rises, the valve 50 starts to move upward as viewed in FIGS. 2 and 3. When it moves a short distance, the input slots 36 and annular grooves 54 line up perfectly for an instant, supplying more area and more flow to the motor 14. This instant, close to motor stall, is several milliseconds, perhaps as much as ten milliseconds, but long enough to raise the stall torque of the motor 14 higher than it would be if the motor stalled before the valve 50 started moving. On a hard job, this is exactly what does happen: the motor 14 stalls before unbalanced air forces can move the valve 50. Immediately after stall, output torque of the tool drops suddenly from its peak stall torque as static friction takes over from sliding friction in the motor and gearing, and in the fastener itself. Seals of rotor blades against cylinder wall in the motor also break down suddenly, reducing the static turning force. In a few milliseconds, 5 to 10 or so is as short a delay as can be achieved, the valve 50 shifts suddenly to the shut-off position. The instantaneous peak stall torque on the hard job is reached while the input flow area is reduced by the misalignment of slots 36 and grooves 54. But the torque resulting from kinetic energy in the rotor pushes torque higher than the static torque. This added torque compensates for the lower stall torque, bringing final torque closer to that achieved on the soft job.

Thus valve 50 including annular grooves 54 and valve sleeve 26 including openings 36 are configured and located relative to each other to define an orifice of variable flow area for supplying fluid from supply passage 16*s* to motor passage 16*m*, the variable orifice having less than maximum flow area when the valve 50 is in the run or normally open position and the variable orifice expanding to maximum flow area during a portion of the travel of the valve 50 from the run to the shut-off position.

As a result, the variable input orifice reduces variation in achieved torque over a range of significantly different work requirements. For example, in the fastener art such range would include jobs from very hard to very soft. The very hard limit is defined as a thirty degree tool revolution from loose to tight, a torque rate of twelve times the target torque per revolution. A very soft job is defined as one which completely absorbs the kinetic energy of the tool while it is decelerating. In practice, two revolutions from loose to tight provide sufficient deceleration for such absorbtion, a torque rate one-half of the target torque per revolution. In the fluid-operated power tool of the present invention, the torque achieved on hard jobs substantially matches the torque achieved on soft jobs. This advantageous result is accomplished by a relatively simple arrangement wherein the shut-off valve 50 itself co-operates with the valve chamber defining sleeve 26 to provide the variable input orifice.

Figures 4, 5, 6:
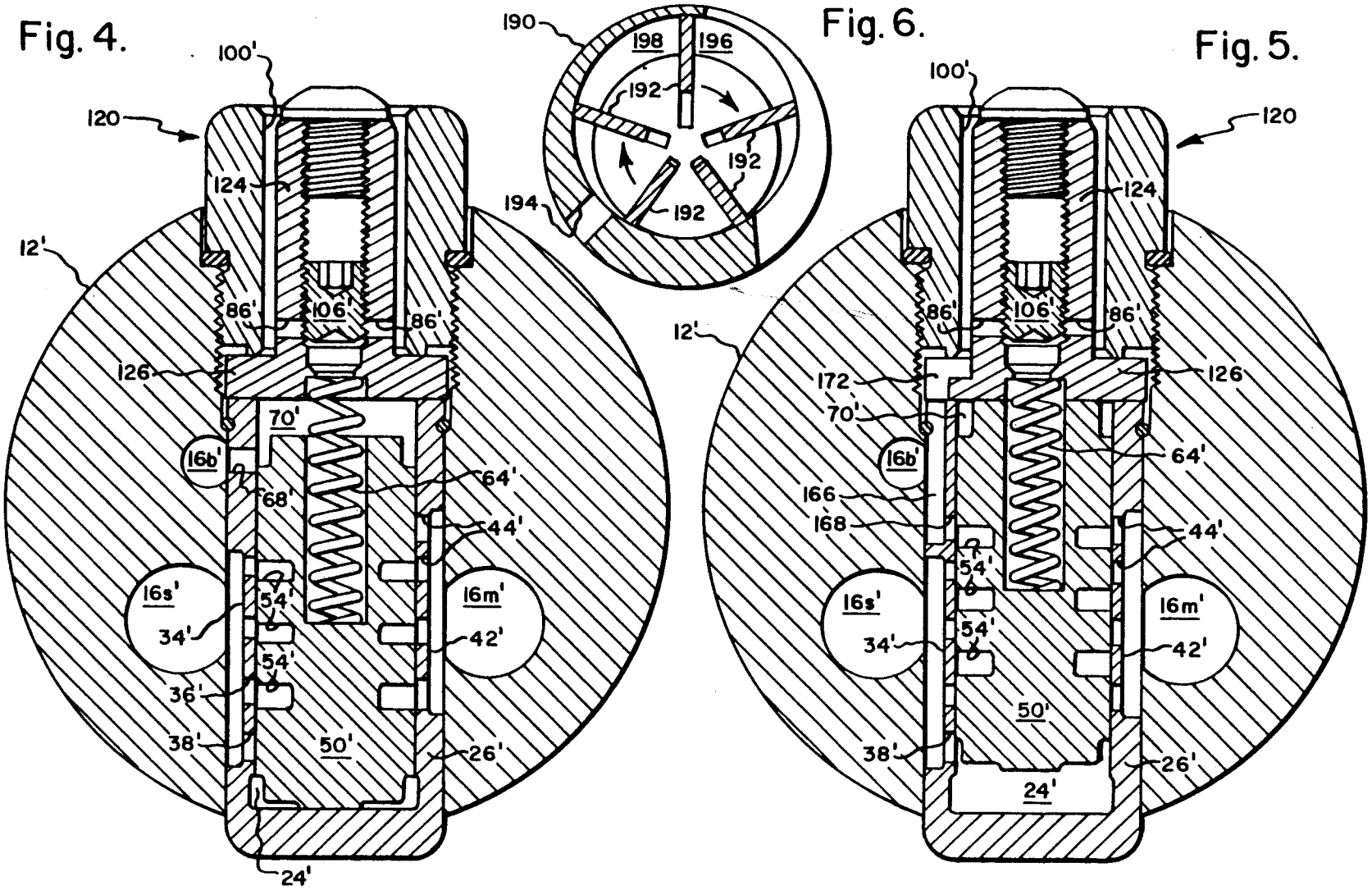
FIG. 4 is a sectional view of a fluid-operated power tool incorporating another aspect of the present invention and showing the shut-off valve in an open position.
FIG. 5 is a sectional view similar to FIG. 4 and showing the shut-off valve in a closed position.
FIG. 6 is a schematic diagram of the interior of a fluid operated motor for a power tool incorporating the present invention.

FIGS. 4 and 5 illustrate a shut-off valve 120 according to another embodiment of the present invention. For convenience, components of shut-off valve 120 identical to those of shut-off valve 20 shown in FIGS. 2 and 3 are identified by the same reference numerals provided with a prime designation. The shut-off valve 120 includes motor dump passage means in fluid communication with the atmosphere external to the tool and under control of valve 50', the motor dump passage means being normally closed to the motor passage 16*m'* and being in fluid communication with the motor passage 16*m'* when valve 50' reaches the closed or shut off condition. For convenience in illustrating the motor dump passage, sleeve 26' and valve block 124 are shown in FIG. 5 rotated about ninety degrees counter-clockwise out of true position. A passage 166 is provided in the wall of sleeve 26', extending along from the open end and terminating near flat 34' where an opening 168 is provided to place passage 166 in communication with the interior of sleeve 26'. An opening 172 in flange 126 of valve block 124 is in communication with passage 166 for venting it to the atmosphere in a manner which will be described.

In operation, inlet air comes from the throttle valve in the tool handle to the flat 34' on the valve sleeve 26'. The slots 36' in the valve sleeve 26' at flat 34' connect with the annular grooves 54' of the shutoff valve 50' which communicate with the slots 44' and flat 42' on the motor side of the valve. The opening 38' takes live air to the side of the shutoff valve 50'. The small chamber 24' at the end of the shutoff valve 50' is pressurized through the fit of the valve in the valve sleeve 26'. Bias passage 16*b'* carries live air from the same source as the inlet. Live bias supply air enters through the hole 68' in the valve sleeve 26' to the chamber 70' at the other end of the shutoff valve 50'. This chamber 70' is bled through the adjustable orifice 86', shown partly occluded by set screw 106'. The pressure in the bias chamber 70' is kept by this bleed a fixed percentage less than the inlet pressure. The spring 64' in the center of the shutoff valve 50' is very light, and serves only to return the valve 50' to the open or run position after shutoff and release of the tool throttle. When the throttle, upstream of the supply passage 16*s'* is depressed, live air flows to the inlet 16*s'* and to the bias chamber 70'. Air flows across the valve 50' in the annular grooves 54' and out through passage 16*m'* to the motor. Air also flows through the fit of valve 50' and sleeve 26' to the end of the valve 50', but since this fit is close, the chamber 24' on the end of the valve 50' is slow to reach pressure, preventing premature shifting of the valve 50'. Air also leaks out of this chamber 24' to the motor, reducing pressure in the chamber 24' to less than inlet pressure.

At free running, pressure in the motor and in chamber 24' drops well below inlet pressure. As the motor is loaded while tightening a fastener, the motor slows, motor pressure increases toward inlet pressure, and so does the pressure in the chamber 24'. Near stall, the pressure in the chamber 24' overcomes the pressure in the bias chamber 70' and the light return spring force, shifting the valve 50' to the shut off position. Bias air supply is shut off by the valve 50' blocking opening 68' and inlet air is led directly to the chamber 24'. The motor passage 16*m'* is vented to motor dump passage 166 and thus to the atmosphere when valve 50' reaches the shut-off position. In particular, when valve 50' reaches the shut-off position of FIG. 5, the upper-most sleeve opening 44' and valve passage 54' place motor passage 16*m'* in communication with motor dump passage 166 through opening 168, and fluid thus flowing from motor passage 16*m'* into motor dump passage 166 is vented to the atmosphere via flange opening 172 and passage 100'.

The advantage of motor dump is illustrated in FIG. 6 which shows in cross-section a fluid-operated rotary vane air motor of the type designated 14 in FIG. 1 and including a housing 190, a plurality of rotor vanes 192 and an inlet passage 194. After a tool shuts off, motor air very quickly vents out the tool exhaust to atmosphere. However, only that air downstream of the blade(s) 192 between inlet and exhaust vents to exhaust. This region is designated 196 in FIG. 6. When this happens, air upstream of that blade is still active. Since motor torque is a function of pressure and blade area, relieving pressure in region 196, on the downstream side of the blade, raises the effective pressure on the upstream side, i.e. region 194, increasing instantaneous motor torque after shutoff. This may be a random amount of increase, depending on specific blade position. In a five-bladed tool, there is one torque cycle every 72 degrees. Torque varies through this cycle, then a similar pattern repeats with the following blade. Expanded air in the next leading pocket between blades, i.e. region 198, also contributes to the torque. Air in this pocket also diminishes quickly at shutoff. Quick motor dump, then, relieves air pressure in region 194, at the same time it is relieved in regions 196 and 198. With effective motor dump, peak torque is closer to set torque, with less variation. The motor dump along with bias shut-off also advantageously reduces impulse or kick of the tool at shut-off.

It is therefore apparent that the present invention accomplishes its intended objects, while embodiments of the present invention have been described in detail, that is for the purpose of illustration, not limitation.

I claim:

1. In a fluid operated shut-off type power tool having a fluid supply passage, a motor passage, a shut-off valve movable from a normally open position to a closed position in response to increase in fluid pressure in said motor passage to a predetermined level, said valve including an input orifice and an output orifice, the input orifice, the input orifice communicating with the fluid supply passage and the output orifice communicating with the motor passage, and means for biasing said valve to maintain valve travel rate of displacement from said normally open position proportional to the rate of increase in the torque load on the motor during loading of the tool:

means including said valve for providing said input orifice of variable flow area for supplying fluid from said supply passage to said motor passage, said variable input orifice having less than maximum flow area when said valve is in said normally open position and said variable input orifice expanding to maximum flow area during a portion of the travel of said valve from said normally open position to said closed position.

2. The power tool of claim 1, wherein said means including said valve is located so that said input orifice is in direct fluid communication with said supply passage and said motor passage.

3. The power tool of claim 1, further including means for defining a valve chamber along which said valve is movable, and wherein said means including said valve for providing said variable input orifice comprises:

(a) first orifice means in said valve chamber defining means and in fluid communication with said supply passage and said motor passage; and (b) second orifice means in said valve and in fluid communication with first orifice means except when said valve is in said closed position.

4. The power tool of claim 3, wherein said valve and said valve chamber defining means are relatively positioned so that when said valve is in said normally open position said first and second orifice means are in partial registry to provide less than the maximum flow area of said input orifice and when said valve moves away from said normally open position said first and second orifice means are in total registry during a portion of the valve movement.

5. The power tool of claim 3, wherein said valve comprises a spool, said valve chamber defining means comprises a sleeve, said spool being movable axially along within said sleeve in close-fitting relation, wherein said first orifice means comprises at least one set of openings in said sleeve each in fluid communication with a corresponding one of said supply and motor passages, and wherein said second orifice means comprises a passage extending laterally of said valve and located to be in communication with said openings except when said valve is in said closed position.

6. The power tool of claim 5, wherein said valve spool and said sleeve are relatively positioned so that when said valve is in said normally open position said openings and said valve passage are in partial registry to provide less than the maximum flow area of said input orifice and when said valve moves away from said normally open position said openings and said valve passage are in complete registry during a portion of the valve movement.

7. The power tool of claim 1, wherein said means for biasing said valve comprises bias passage means for directing fluid from said supply passage against a portion of said valve to urge said valve toward said normally open position.

8. The power tool of claim 7, wherein said bias passage means is located relative to said valve so as to be closed when said valve reaches said closed position.

9. The power tool of claim 1, including means for directing fluid from said motor passage against a portion of said valve to urge said valve toward said closed position.

10. A shut-off type fluid operated power tool comprising:

(a) a housing having a fluid supply inlet passage and a motor fluid passage;

(b) a motor in said housing and operated by fluid from said motor passage, said motor having a free running no load speed at a predetermined supply fluid pressure which decreases in speed as torque loading on the motor increases;

(c) means in said housing for defining a valve chamber including passage means for enabling fluid to flow from said inlet passage through an input orifice to the valve chamber and through an output orifice to said motor passage;

(d) a valve movable in said chamber and operatively associated with said valve chamber passage means for controlling fluid flow between said inlet passage and said motor passage, said valve being movable between a run position allowing fluid flow from said inlet passage to said motor passage and a shut-off position blocking fluid flow from said inlet passage to said motor passage;

(e) means for directing fluid under motor operating pressure against one portion of said valve for moving said valve away from said run position and toward said shut-off position;

(f) means for applying bias force against another portion of said valve for urging said valve toward said run position for balancing the force of motor operating pressure acting on said valve until a specified torque load on said motor is reached whereupon said valve moves to said shut-off position; and (g) said valve and said passage means of said valve chamber being configured and located relative to each other to define said input orifice of variable flow area for supplying fluid from said supply passage to said motor passage, said variable input orifice having less than maximum flow area when said valve is in said run position and said variable input orifice expanding to maximum flow area during a portion of the travel of said valve from said run position to said shut-off position.

11. The power tool of claim 10, wherein said valve comprises a spool, said valve chamber defining means comprises a sleeve, said spool being movable axially along within said sleeve in close-fitting relation, wherein said passage means of said valve chamber means comprises at least one set of openings in said sleeve each in fluid communication with a corresponding one of said supply and motor passages, and wherein said valve includes a passage extending laterally of said spool and located to be in communication with said openings except when said valve is in said shut-off position.

12. The power tool of claim 11, wherein said valve spool and said sleeve are relatively positioned so that when said valve is in said run position said openings and said valve passage are in partial registry to provide less than the maximum flow of said orifice and when said valve moves away from said run position said openings and said valve passage are in complete registry during a portion of the valve movement.

13. The power tool of claim 10, wherein said means for applying bias force comprises bias passage means for directing fluid from said supply passage against a portion of said valve to urge said valve toward said run position.

14. The power tool of claim 13, wherein said bias passage means is located relative to said valve so as to be closed when said valve reaches said shut-off position.

15. A shut-off type fluid operated power tool comprising:

(a) a housing having a fluid supply inlet passage and a motor fluid passage;

(b) a motor in said housing and operated by fluid from said motor passage, said motor having a free running no load speed at a predetermined supply fluid pressure which decreases in speed as torque loading on the motor increases;

(c) orifice means in said housing for providing fluid flow from said inlet passage to said motor passage;

(d) a valve movable in said chamber and operatively associated with said orifice means for controlling fluid flow between said inlet passage and said motor passage, said valve being movable between a run position allowing fluid flow from said inlet passage to said motor passage and a shut-off position blocking fluid flow from said inlet passage to said motor passage;

(e) means for directing fluid under motor operating pressure against one portion of said valve for moving said valve away from said run position and toward said shut-off position;

(f) bias fluid passage means for directing bias fluid pressure against another portion of said valve for urging said valve toward said run position for balancing the force of motor operating pressure acting on said valve until a specified torque load on said motor is reached whereupon said valve moves to said shut-off position;

(g) said bias passage means being located relative to said valve so as to be closed when said valve reaches said shut-off position; and (h) motor dump passage means in fluid communication with the atmosphere external to the tool and under control of said valve, said motor dump passage means being normally closed to said motor passage and being in fluid communication with said motor passage when said valve reaches said closed condition.

16. The power tool of claim 15, wherein said valve and said orifice means are configured and located relative to each other to define an orifice of variable flow area for supplying fluid from said supply passage to said motor passage, said variable orifice having less than maximum flow area when said valve is in said run position and said variable orifice expanding to maximum flow area during a portion of the travel of said valve from said run position to said shut-off position.

17. A fluid operated shut-off type power tool comprising a fluid supply passage, a motor passage, a shut-off valve movable from a normally open position to a closed position in response to increase in fluid pressure in said motor passage to a predetermined level, biasing means for biasing said valve to maintain valve travel rate of displacement from said normally open position proportional to the rate of increase in the torque load on the motor during loading of the tool, variable flow area means including said valve for providing an input orifice of variable flow area for supplying fluid from said supply passage to said motor passage, said variable input orifice having less than maximum flow area when said valve is in said normally open position and said variable input orifice expanding to maximum flow area during a portion of the travel of said valve from said normally open position to said closed position, and motor dump passage means in fluid communication with the atmosphere external to the tool and under control of said valve, said motor dump passage means being normally closed to said motor passage and being in fluid communication with said motor passage when said valve reaches said closed condition.

18. A shut-off type fluid operated power tool comprising:

(a) A housing having a fluid supply inlet passage and a motor fluid passage;

(b) a motor in said housing and operated by fluid from said motor passage, said motor having a free running no load speed at a predetermined supply fluid pressure which decreases in speed as torque loading on the motor increases;

(c) means in said housing for defining a valve chamber including passage means for enabling fluid to flow from said inlet passage to said motor passage;

(d) a valve movable in said chamber and operatively associated with said valve chamber passage means for controlling fluid flow between said inlet passage and said motor passage, said valve being movable between a run position allowing fluid flow from said inlet passage to said motor passage and a shut-off position blocking fluid flow from said inlet passage to said motor passage;

(e) means for directing fluid under motor operating pressure against one portion of said valve for moving said valve away from said run position and toward said shut-off position;

(f) means for applying bias force against another portion of said valve for urging said valve toward said run position for balancing the force of motor operating pressure acting on said valve until a specified torque load on said motor is reached whereupon said valve moves to said shut-off position;

(g) said valve and said passage means of said valve chamber being configured and loated relative to each other to define an orifice of variable flow area for supplying fluid from said supply passage to said motor passage, said variable orifice having less than maximum flow area when said valve is in said run position and said variable orifice expanding to maximum flow area during a portion of the travel of said valve from said run position to said shut-off position; and (h) a motor dump passage means in fluid communication with the atmosphere external to the tool and under control of said valve, said motor dump passage means being normally closed to said motor passage and being in fluid communication with said motor passage when said valve reaches said closed position.

* * * * *